United States Patent [19]

Gueguen

[11] 4,230,308

[45] Oct. 28, 1980

[54] AUTOMATED CASTING LINE SUPPLY SYSTEM

[76] Inventor: Eugene Gueguen, 14 rue de la Gare, 55000 Bar Le Duc, France

[21] Appl. No.: 889,135

[22] Filed: Mar. 22, 1978

[51] Int. Cl.[3] ..... C21D 11/00

[52] U.S. Cl. ..... 266/92; 164/155; 164/323; 164/335; 266/236; 266/276

[58] Field of Search ..... 164/155, 322, 323, 335, 164/437; 222/607; 266/92, 236, 276

[56] References Cited

U.S. PATENT DOCUMENTS 4,114,675 9/1978 Buhrer ..... 164/155 X

FOREIGN PATENT DOCUMENTS 2356468 1/1978 France ..... 164/322

*Primary Examiner*—Paul A. Bell

*Attorney, Agent, or Firm*—Weiser, Stapler & Spivak

[57] ABSTRACT

A heated ladle provides a reserve of molten metal. Vertical closing rods release desired quantities into pouring troughs. These are indexed into alignment with the mold casting orifices. The system includes a chassis movable parallel to the step-by-step movable casting line, a mobile cart carried by the chassis and also movable parallel to the line, and trough-bearing means movable perpendicularly to the line and also providing pivotal movement capability for the troughs. Reference marks on the molds or inter-mold spaces cooperate with position sensors to control the indexing. Redescent and resulting closing of the closing rods is automatic.

10 Claims, 7 Drawing Figures

AUTOMATED CASTING LINE SUPPLY SYSTEM

The present invention relates to improvements in supply systems, particularly for continuous casting lines. It relates more particularly to an automated supply system for the casting of various metals and alloys either within metal molds, or within sand molds and, among the latter, those referred to as using boxless molding.

Before discussing the principal features of the invention, it is in order to recall the difficulties encountered when using known means to carry out the casting of metals.

These means are constituted primarily by different types of casting ladles. These ladles are most often loaded at a first filling station, at the location of the melting furnace. They are then transported to a second, pouring position, at the location of the one or more molds to be filled.

The transportation of the ladle takes place most often suspended from a mobile support beam, whose operators must manually control the filling, the transfer and the pouring.

This method of casting requires, in the specific case of so-called continuous casting lines, very numerous transfers of molten metal, with all of the dangers and technological drawbacks inherent in this method of casting.

Among the technical drawbacks, there is noted particularly the necessity of transfer, the difficulty of controlling the quantity of metal poured into the molds, the risks of overflow, the temperature drops leading to molecular or structural changes in the molten material because of the transfer time and, above all, the difficulties of pouring the said molten material into the molds carried by a mold-carrying conveyor, which advances in steps and whose area of immobilization for casting always turns out to be imprecisely located.

Among the dangers of operation for the workers, there will be noted the risks caused by the movement of the ladles, the close proximity of molten metal, the maneuvering of the ladle particularly during filling of the molds.

Accordingly, an object of the present invention is to overcome these drawbacks by providing an improved automated casting system having, in combination, a large reserve of molten metal at the casting location, closing means for each casting operation, indexing means to produce alignment between the one or more pouring troughs of the system with the casting orifices or gates of the molds, and finally means for automatically insuring the pouring of a predetermined quantity of molten metal.

To that end, the invention relates to a supply system for molten metal, especially for filling the molds upon continuous mold conveyors, the supply system being characterized in that it includes in combination, on the one hand, a chassis which is normally stationary during the casting operation, but which is displaceable upon a rollway or track, such as rails, extending parallel to a portion of the path of a mold bearing conveyor equipped with step-by-step advancing means. The above-mentioned chassis is equipped with a cart which is displaceable between two abutments. This cart is provided with a heated ladle providing a metal reserve permanently maintained in molten state. The ladle includes one or more closing rods which control delivery of the molten metal contained in the ladle, on the other hand one or more pouring troughs positioned within the above-mentioned mobile cart and adapted to lead the metal delivered from the ladle to the casting orifices of the molds. Furthermore, the said troughs are adjustable in position in a direction perpendicular to the direction of movement of the mobile cart and they are also adjustable angularly in a horizontal plane about a pivot point, still on another hand means adapted to control the quantity of metal delivered by the one or more closing rods, and finally, indexing means adapted to control the displacing means of the mobile cart to provide precise positional alignment between the one or more pouring troughs and the one or more casting orifices of the molds. Due to this, all requirements attributable to transfer and operation of the ladles of previously known arrangements are eliminated. The productivity is increased. Losses of materials are avoided and the workers are protected since they no longer have the task of filling, pouring, or dosing a molten substance.

In accordance with a feature of the invention, the one or more closing rods which equip the heated ladle providing the molten metal reserve, are made of monobloc (unitary) construction without metallic core, and of an essentially alumina-based material. These closing rods are positioned vertically, and provided with a spherical lower extremity which rests, when the rods are closed, upon the seat of an orifice which, on the one hand, may be closed at its end opposite to the closing rod seat and which, on the other hand, has a structure enabling its demounting from outside the ladle. Because of their composition the closing rods cannot become immobilized in the metal bath. By virtue of their external closure, the orifices enable rapid replacement of the closing rods during operation of the system, since it is no longer necessary to empty the ladle, as had been the case for previously known ladles. Finally, replacement of the orifices may be carried out after emptying without having to penetrate into the ladle.

According to another embodiment of the invention, the displacements of the trough-carrying cart between the abutments of the chassis-which is normally stationary during the casting operation, are provided preferably by an electromechanical jack which produces displacement of said trough-carrying cart at a speed higher than the speed of advance of the casting line. Due to this arrangement, alignment between the troughs and the casting orifices of the molds or boxless molding devices takes place at the time of immobilization of the line after a one-step advance. This occurrence of alignment precludes all possible danger of overflow of liquid metal, right from the start of the casting operation.

The position control of the molten metal transfer troughs is obtained, on the one hand, perpendicularly to the direction of movement of the mobile cart, by an intermediate cart displaceable on a rollway or track, and on the other hand, angularly in a horizontal plane about a pivot carried by the intermediate cart.

This arrangement makes it possible to cover the entire surface of the molds or boxless molding devices and to place the pouring system parallel to the path of the molds and not above, as had been the case in most of the systems previously known in the art of supplying continuous lines.

In accordance with a first embodiment, the control means for the metal quantity delivered by the closing rods from the heated ladle consists of an infra-red detector positioned near a vent of the molds carried by the continuous line. This detector emits an electrical signal which is applied to the system which controls the re-descent and consequent closing of the closing rods when the filling level of the molds is reached.

In accordance with a second embodiment, the control means for the quantity of metal delivered consists of a mechanical balance with known deflection sensor. This balance is provided with a ladle capable of occupying at least two positions, one for filling and weighing, the other for pouring into a pouring trough. After having reached a threshold weight level, the said balance emits an electrical signal which is supplied to the control arrangement for the re-descent and closure of the closing rods before the said pouring.

Finally, according to a third embodiment, the control means for the quantity of metal delivered by the closing rods consists of a timing arrangement which emits an electrical signal applied to the control arrangement for the re-descent or closure of the closing rods is reached.

According to an essential feature of the invention, the indexing means adapted to control the movement of the main trough-bearing cart consists on the one hand, of reference marks carried by the molds or boxless molding devices of the casting line, or constituted by the between-mold spaces, and on the other hand, of sensors adapted to emit signals which are applied to the displacing means of the trough-carrying cart in order to bring these troughs into alignment with the casting orifices of the molds or boxless molding devices, and signals applied to the control arrangement for opening the closing rods upon reaching alignment between the reference marks and the sensors.

Finally, it will be noted that the molten metal reserve ladle is preferably heated by induction, but may also be heated by a flame burner.

Other characteristics and advantages of the invention will appear from the detailed description which follows of an embodiment given by way of example and illustrated in the accompanying drawings wherein.

Figure 1:
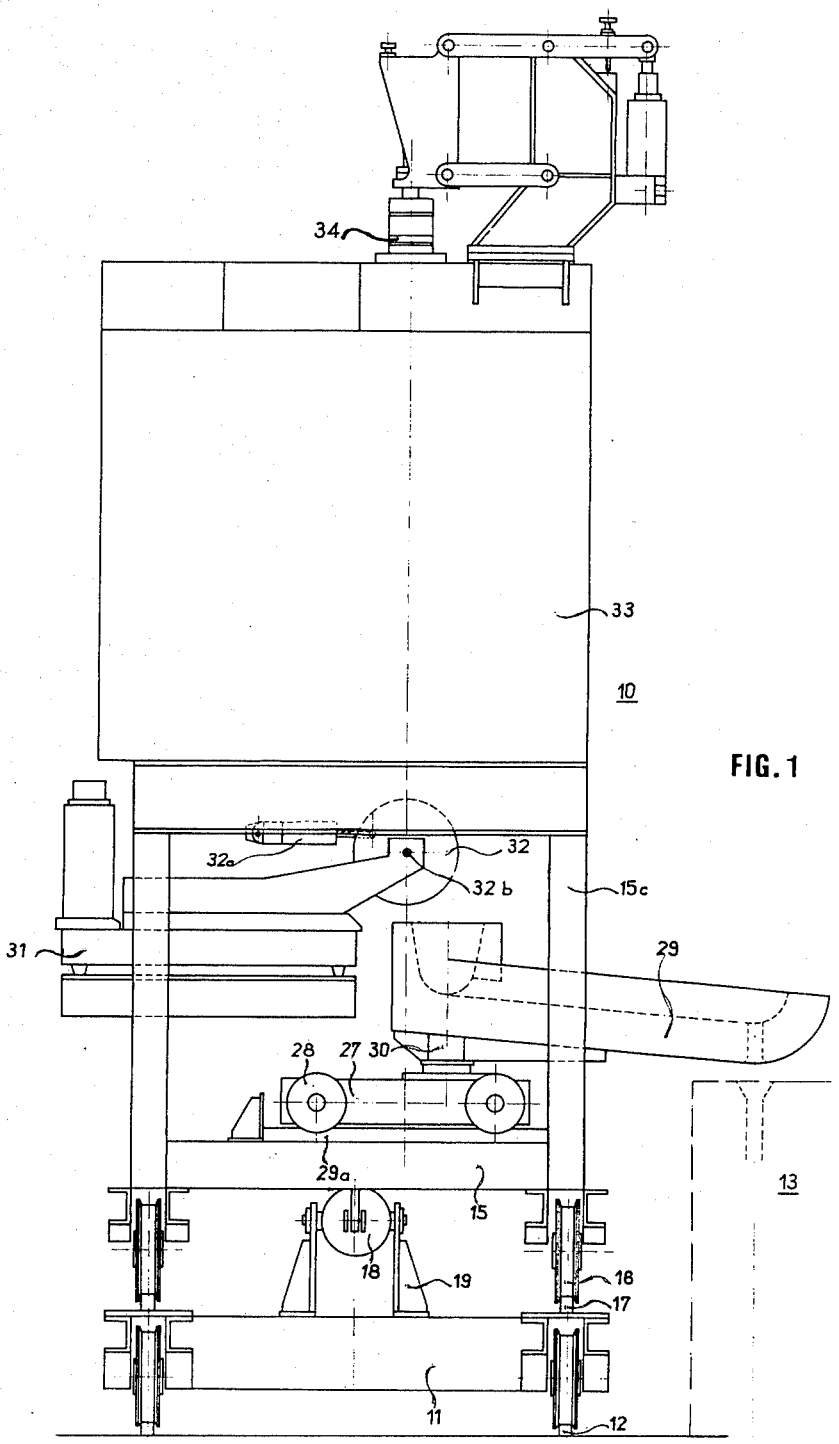
FIG. 1 is an elevation view of a first embodiment of an automated pouring system according to the invention.
Figure 2:
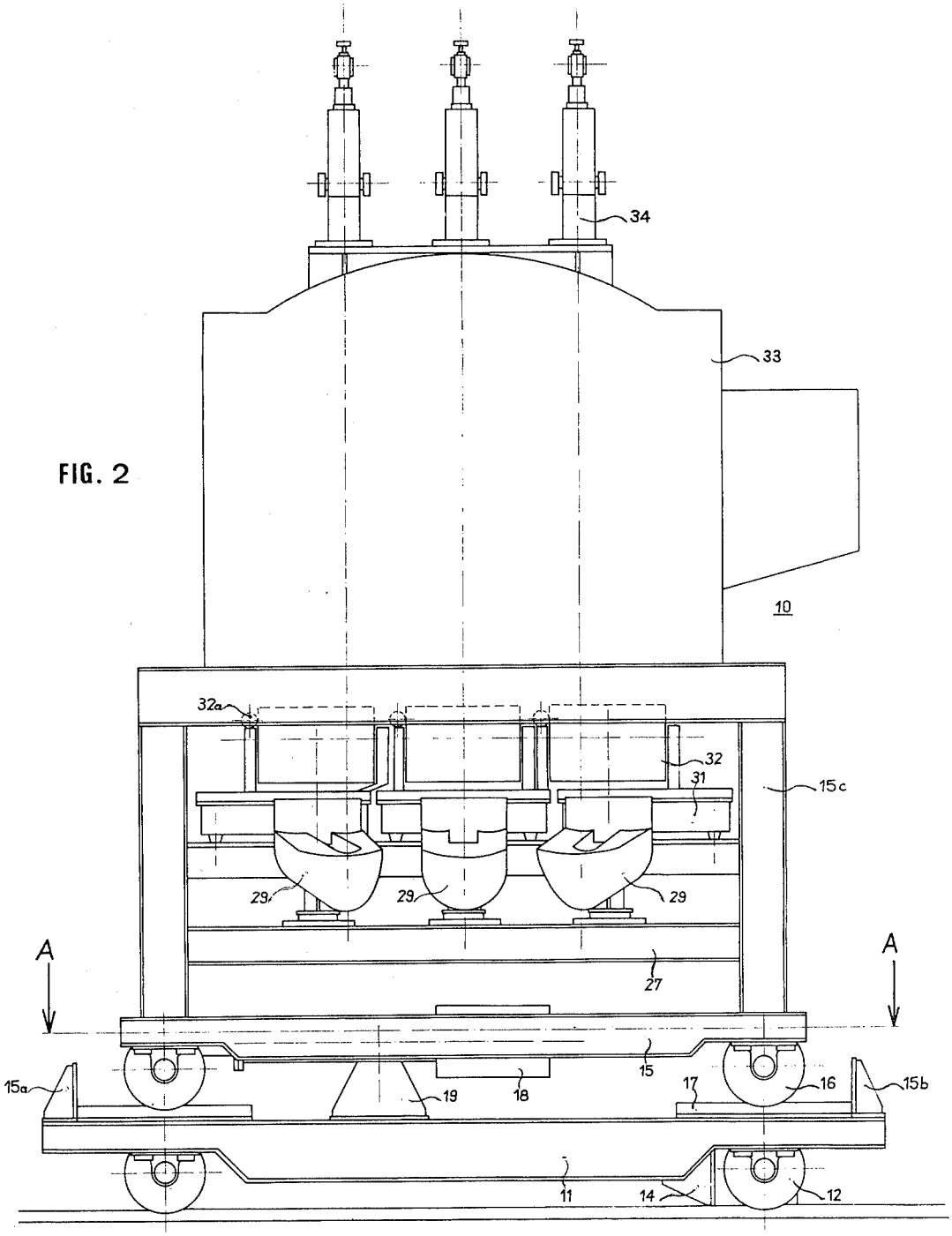
FIG. 2 is a side view of the system of FIG. 1.

In accordance with the invention and as shown in the accompanying drawings, the molten metal supply system is designated by the general reference numeral 10. This system is comprised of a first chassis 11 which is normally stationary during the pouring operation. However, this chassis is displaceable upon a rollway 12, such as rails, extending parallel to a portion of the travel of a continuous casting line designated by the general reference numeral 13. Chassis 11 is provided with a reduction motor assembly, propelling the wheels in such a manner that the system may be positioned and immobilized within the casting zone of the molds, and that it is equally possible to produce rapid displacement outside the working zone.

Chassis 11 is equipped with a mobile cart movable between two abutments 15*a*, 15*b* supported by chassis 11. Cart 15 is mounted on wheels 16 which rest on a segment of track 17.

Figure 3:
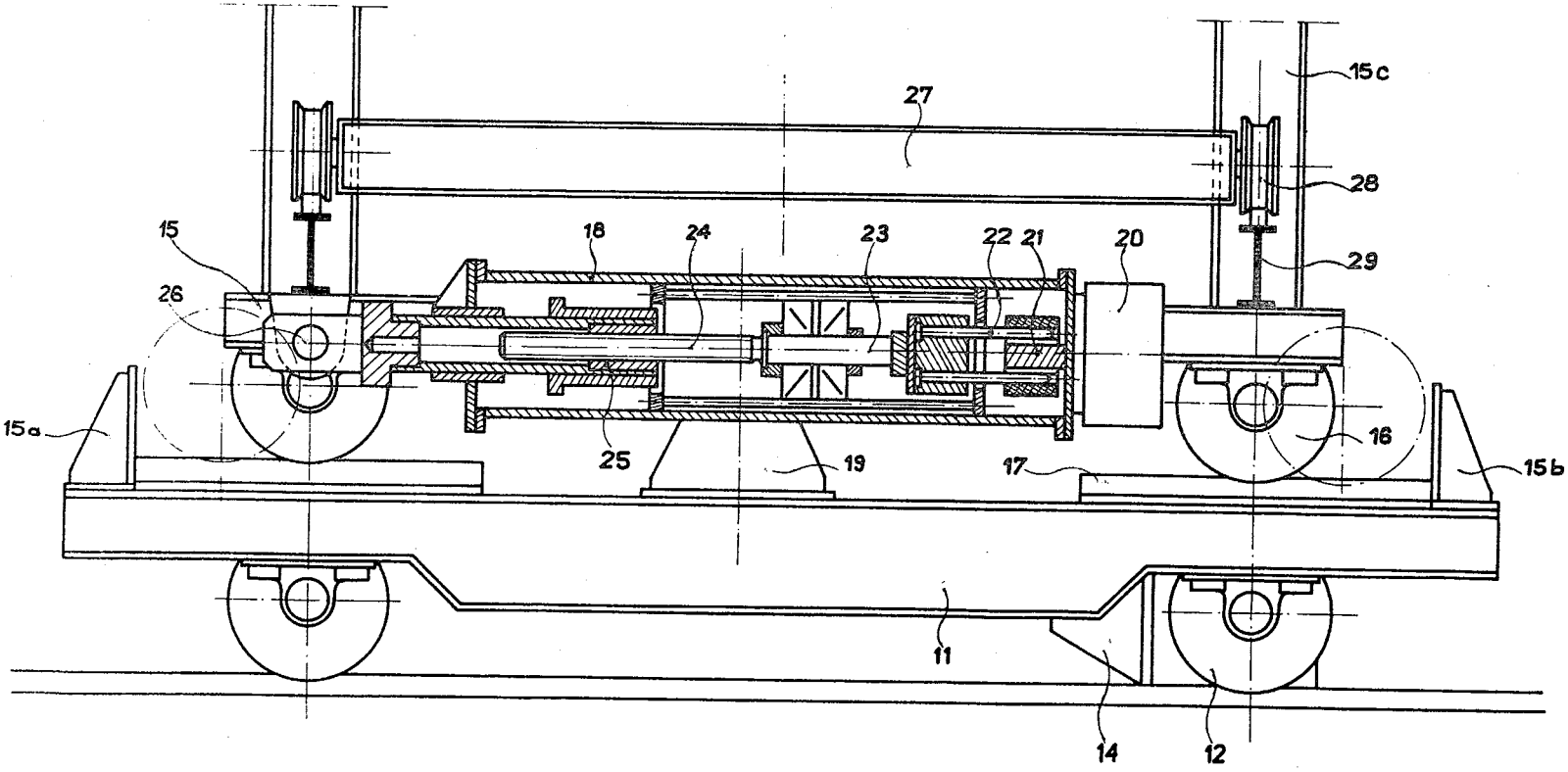
FIG. 3, is a view, partially in cross-section, along A—A in FIG. 2.

Displacements of cart 15 upon chassis 11 are obtained, in the embodiment shown, by an electromechanical jack 18, a detailed embodiment of which will appear from consideration of FIG. 3. The electromechanical jack 18 is connected to chassis 11 by means of a support 19 unitary with the chassis. The electromechanical jack 18 includes an electrical motor 20 whose output shaft turns, through the intermediary of a coupling 22, a control shaft 23 positioned on the axis of the jack body 18. Shaft 23 extends into a control screw 24 acting upon a follower 25 which can be displaced axially along screw 24 in one direction or the other depending upon the direction of rotation impressed upon screw 24. Follower 25 is connected via an attachment point 26 to cart 15.

It will be noted that the displacements of cart 15 take place parallel to the displacement path of chassis 11. The rapid displacements of cart 15 have the purpose of producing alignment between the pouring trough and the casting holes of the molds carried by the continuous line which provides step-by-step displacement of the molds or boxless molding devices.

The principle of the indexing system for the casting molds will be described later in reference to FIG. 4.

Cart 15 in turn includes a trough-carrying cart 27 provided with wheels 28 resting upon a rollway 29*a* perpendicular to the rollway 17 for cart 15.

Cart 27 is equipped with one or more troughs 29 pivotally mounted upon a vertical shaft 30 carried by cart 27, so as to be able to be displaced angularly about the said shaft.

In FIGS. 1 to 5 the system is equipped with a known mechanical balance 31, with deflection sensor. The balance is provided with a transfer ladle 32 which receives its molten metal charge from a ladle 33 constituting the molten metal reserve.

Transfer ladle 32 is angularly displaceable about a shaft 32*b* in such manner as to be able to occupy at least two positions, one of filling and weighing, the other of emptying into the one or more pouring troughs 29. Ladle 33 is of heated type and is supported at the top of uprights 15*c* of cart 15.

Figure 5:
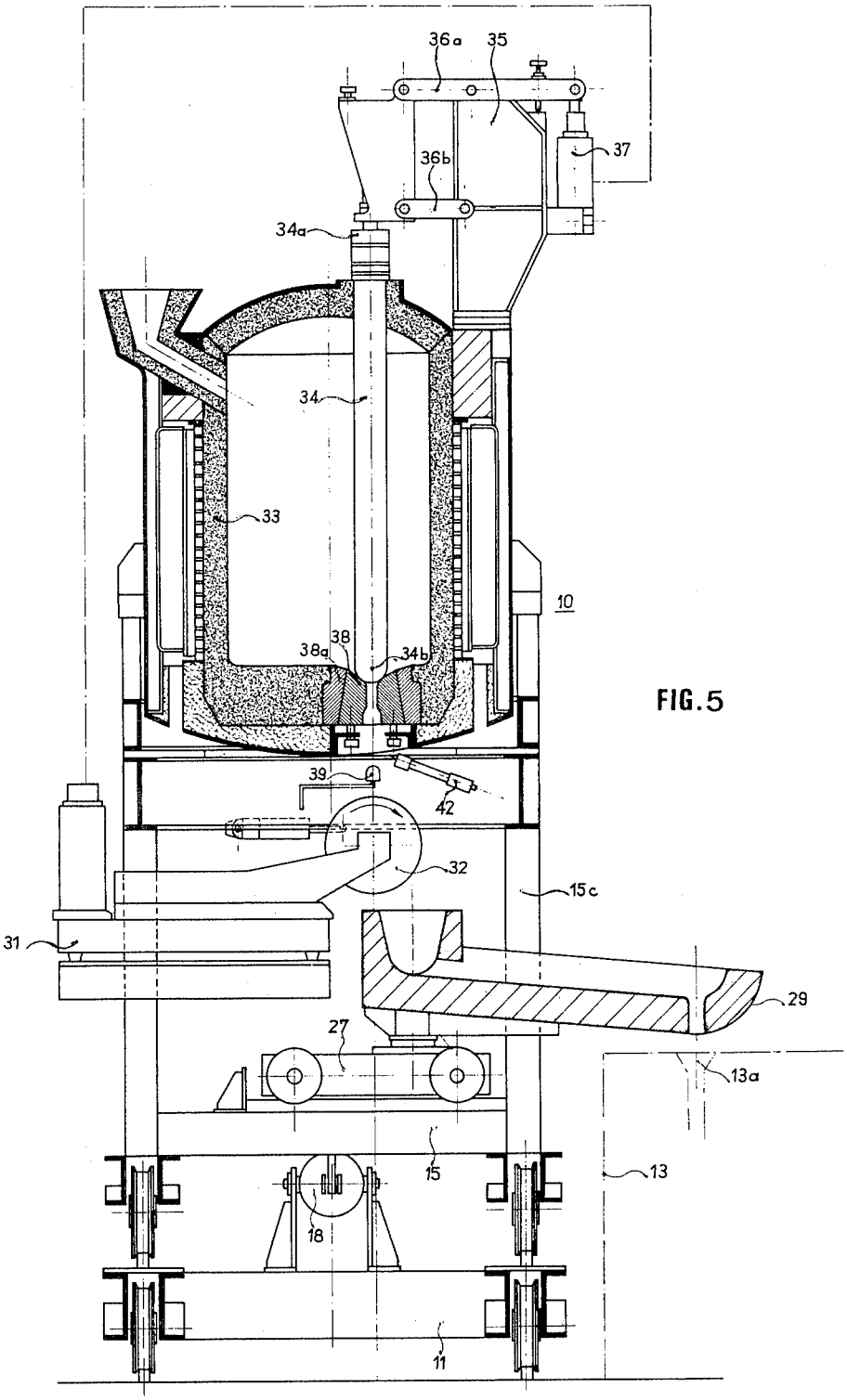
FIG. 5 is an elevation view, partially in cross-section, showing a pouring system equipped with a pouring ladle heated by induction.
Figure 6:
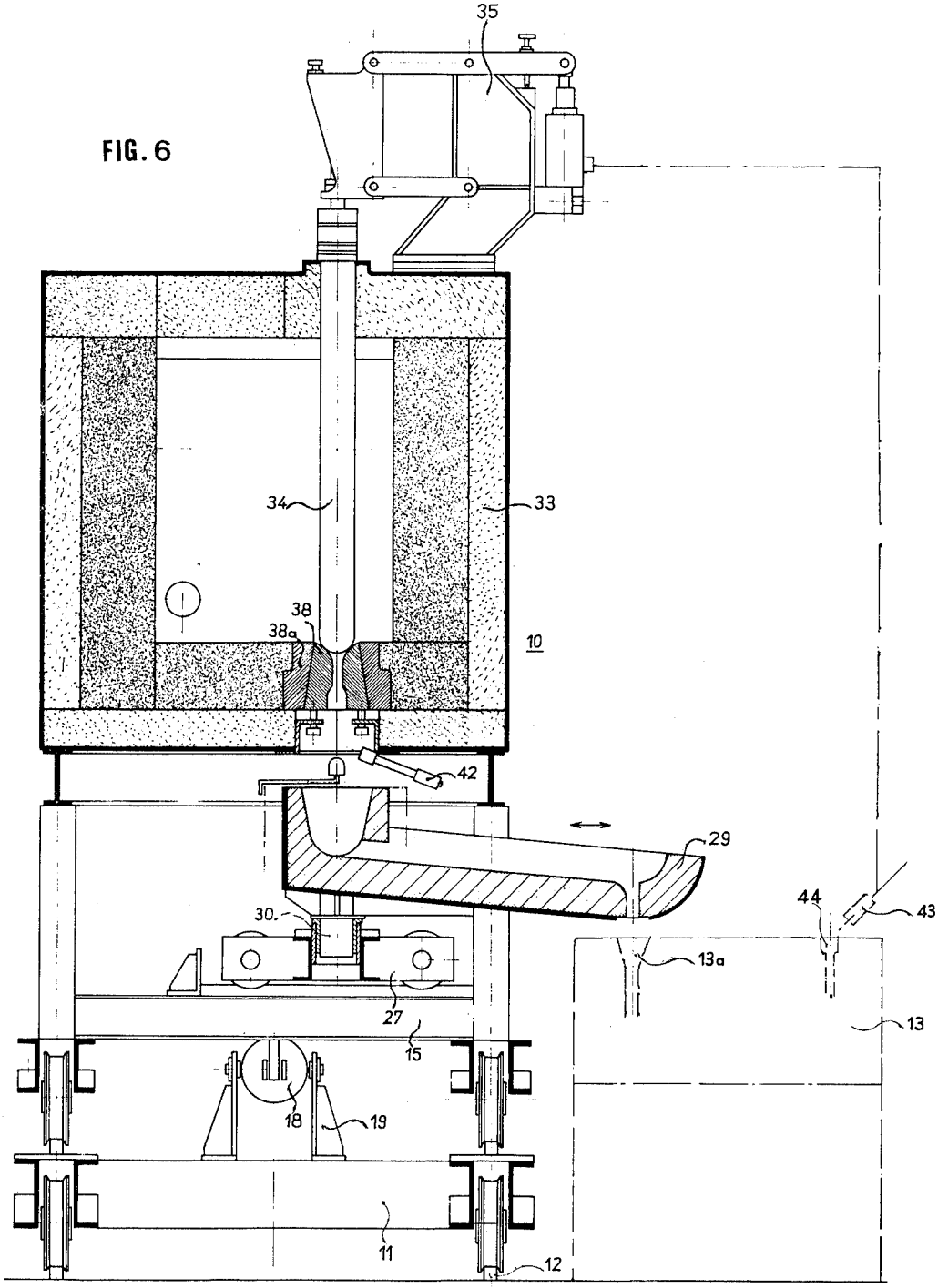
FIG. 6 is an elevation view, partially in cross-section, showing another embodiment of the system.
Figure 7:
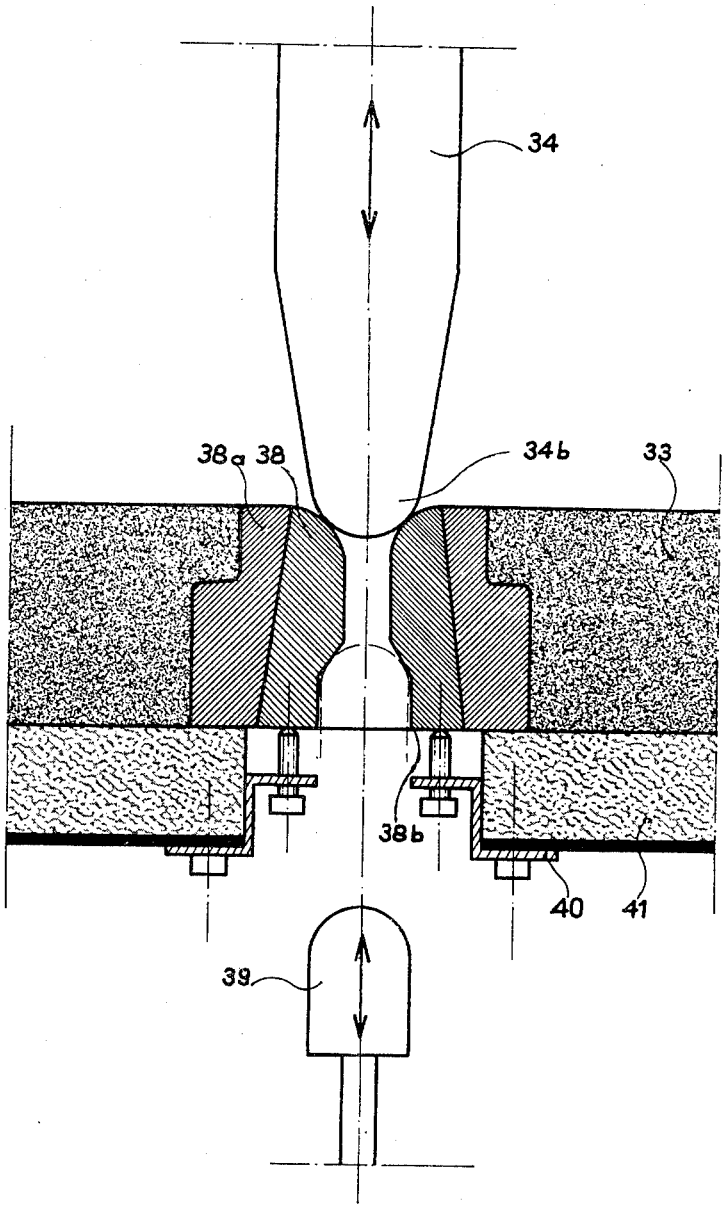
FIG. 7 is a view, partially in cross-section and to a larger scale, showing an embodiment of a closing rod adaptable to any one of the embodiments of the pouring system represented in FIGS. 1 to 6.

Referring to FIGS. 5 to 7, and regardless of the method of heating for ladle 33, each ladle is equipped with one or more closing rods 34 positioned vertically within ladle 33. Each closing rod can be displaced axially by means of a displacement control arrangement 35 acting upon the upper extremity 34*a* of a closing rod through the intermediary of linkages 36*a*, 36*b* constituting a deformable parallelogram, linkage 36*a* being itself operated by means of a jack 37.

According to one embodiment, the closing rods 34 are of unitary construction, without metallic core and essentially of alumina-based material. Each closing rod exhibits a lower spherical extremity 34*b* which, in the closed state of the closing rods, rests upon the seat 38 of an orifice provided in the base of ladle 33. The outer end of orifice 38 can be closed at the end opposite to the seat of the closing rod by means of a movable plug 39. As a result, it is possible to carry out replacement of the closing rod while the system is operation.

According to another structural characteristic, the orifice 38 and the orifice bushing 38*a* are of cylindro-conical configuration, diverging from the seat of the closing rod toward the outside of the ladle 33. This makes it possible to remove the said orifice from outside the ladle. Attachment of orifice 38 in the opening defined by the orifice bushing 38*a* is provided by straps 40 positioned between superstructure 41 of ladle 33 and the outer front face 38*b* of the orifice.

In the illustrative embodiment of FIG. 5, ladle 33 is of the type heated by induction. On the other hand, in the embodiment of FIG. 6, the ladle is heated by flame burners.

It will also be noted that, regardless of the embodiment used, the system is provided in the vicinity of the lower extremity of orifices 38, with a re-heating burner 42 which prevents possible gelling of the molten material at the exit of the said orifice in the event of extended stoppage of the system, e.g. meal times.

According to a first embodiment, represented in FIG. 6, the control means for the quantity of metal delivered by the closing rods 34 employs an infra-red detector 43 positioned in the vicinity of a vent 44 in molds 13 carried by the continuous casting line. The operation is then as follows: after indexing between trough 29 and casting orifice 13*a*, an electrical signal is produced by an indexing arrangement such as the one which will be described in detail with reference to FIG. 4. This signal is applied to control arrangement 35 for the closing rods to cause them to open. In that case, the molten metal delivered by closing rods 34 drops directly into adjustable trough 29 and from there into the casting orifice 13*a* of mold 13. When the molten metal reaches a predetermined level within mold 13 the infra-red detector 43 puts out an electrical signal which is supplied to arrangement 35 causing re-descent and closing of the closing rods.

It goes without saying that there can also be contemplated control of the quantity of molten metal delivered into a mold by means of a timer acting upon the control arrangement 35 for the closing rods.

In the embodiment of FIGS. 1 to 5 the control means for the quantity of metal delivered are provided by mechanical balance 31 described previously.

The balance, upon reaching a control weight threshold, puts out an electrical signal which is applied to arrangement 35 which then controls the re-descent and closing of the closing rods.

Figure 4:
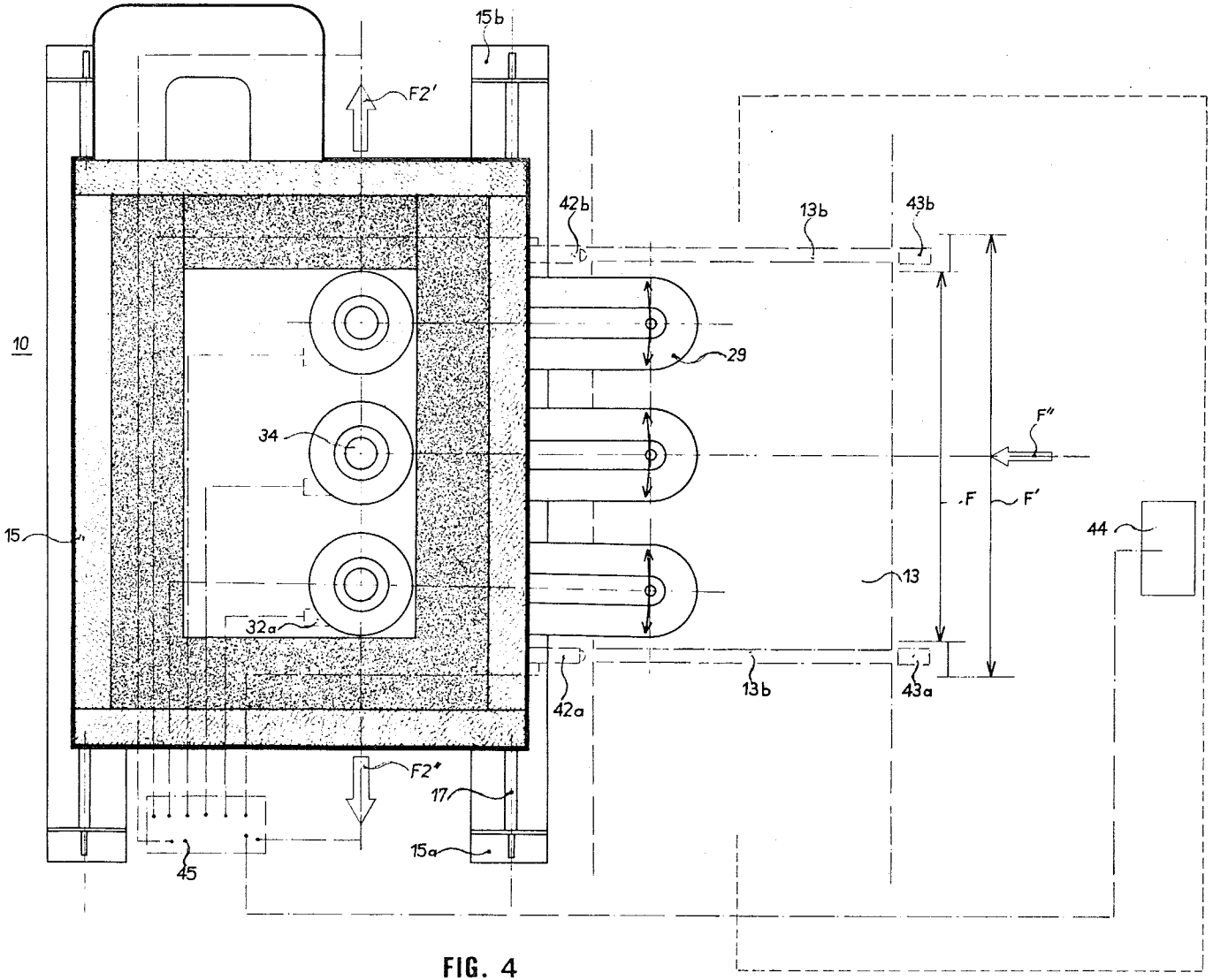
FIG. 4 is a top view of the system showing the operating principle thereof.

Referring to FIG. 4, there will now be described an illustrative embodiment for producing alignment between the pouring troughs 29 and the casting orifices 13*a* of molds 13 carried by a continuous casting line.

In that Figure, arrow F indicates the ideal immobilization region of a mold 13 during the casting operation. Arrow F′ shows the actual limits between which a mold 13 can be immobilized at any given point.

In consequence, the casting unit 10 and especially cart 15 must be displaced in one direction or the other from a neutral position indicated by arrow F″. To arrive at this result, different indexing means may be utilized (mechanical, proximity contact, optical). In all cases, there are used between the boxless molding device carried by the line, reference marks attached to the molds or, as in the example illustrated, in the spaces 13*b* which separate the molds.

There will be attached to the pouring system and particularly to the cart 15 two sensors, e.g. optical, respectively designated by reference numerals 42*a*, 42*b*, positioned adjustably upon chassis 15 in such manner as to be capable of framing the two front faces of a mold 13.

Sensors 42*a*, 42*b* are capable of being excited by lamps 43*a*, 43*b*, whose beams can traverse the intermold spaces 13*b*.

In case of optical indexing, a signal generator 44 associated with the casting line puts out a signal when a mold 13 approaches its casting position to the degree defined by the limits of arrow F′.

This signal is applied to a control box 45, also part of the pouring system, and from which there is triggered the start of the pouring system cycle. This can then follow the end of the forward movement of a mold 13 as it approaches its stationary casting position.

The cells or sensors, respectively 42*a*, 42*b*, relayed through the control box 45, provide an impulse to jack control motor 18 to displace cart 15 either in the direction of arrow $F_2'$ or in the direction of arrow $F_2''$. When optical sensors 42*a*, 42*b* are aligned with lamps 43*a*, 43*b* the jack control motor 18 is disconnected and simultaneouly a control signal is applied to closing rod control arrangement 35 to cause these to open.

The molten metal is delivered into the one or more intermediate ladles 32 and after the one or more balances 31 have reached their weight control threshold, the control arrangement 35 is actuated to cause closing of closing rods 34. A signal is then applied to control jack 32*a* which causes pouring movement of intermediate ladles 32 into the troughs 29.

After one-step displacement of the casting line, a new cycle begins.

A pouring system as described above makes it possible to achieve a rate of casting of about 300 molds per hour. This is quite exceptional compared to previously known arrangements which were not capable of exceeding approximately 240 molds per hour.

Casting weight variable from 0.20 to 50 kg.

Number of casting orifices supplied: 1 to 3.

Number of weighing arrangements: 1 to 3.

Storage capacity: from 1,000 to 3,000 kg of molten metal.

Heating of the reserve ladle may be achieved either by fuel oil, gas or electricity.

The number of closing rods is also between 1 and 3.

By way of example, a machine with three closing rods and three weighing arrangements may operate with 1, 2 or 3 of them in operation, with three indexings of different weights.

The entirely automated pouring system therefore permits supplying the exact weight of metal necessary to properly fill a foundry mold.

The system can function with any ferrous or non-ferrous metal, it can supply simultaneously or separately 1, 2 or 3 casting orifices, and with potentially different weights of metal as has been indicated.

It will be understood that the invention is not limited to the embodiments described and illustrated above, in which other variants may be provided without thereby departing from the scope of the accompanying claims.

I claim:

1. Molten metal supply system, particularly for filling molds or boxless moldings upon a continuous casting line, the supply system comprising in combination:

a chassis which is normally stationary during the casting operation but displaceable upon a rollway, such as rails, positioned parallel to a portion of the path of a mold bearing conveyor equipped with a step-by-step advancing means, the said chassis being provided with a cart movable between two abutments, the cart being provided with a heated ladle constituting a reserve of metal permanently maintained in molten state, the ladle comprising one or more closing rods controlling delivery of the molten metal contained within the ladle, one or more pouring troughs disposed in said mobile cart and adapted to lead the metal delivered from the ladle to casting orifices of the molds or boxless molding devices, said troughs further being adjustable in a direction perpendicularly to the displacement direction of the mobile cart and angularly adjustable in a horizontal plane around a pivot, means adapted to control the quantity of metal delivered by the one or more closing rods, and indexing means adapted to control the mobile cart displacement means to provide precise positional alignment between the one or more pouring troughs and the one or more casting orifices of the molds.

2. The supply system of claim 1 wherein the one or more closing rods with which the heated ladle is equipped which constitutes the molten metal reserve are of unitary construction, without metallic core and of a substantially alumina-based material, the said closing rods being positioned vertically and exhibiting a spherical lower extremity which rests, in the closed state of the closing rods, upon the seat of an orifice which is capable of being closed at the end opposite to the closing rod seat and which has a structure enabling its disassembly from outside the ladle.

3. A supply system according to claim 1 wherein the displacements of the trough-bearing mobile cart between the abutments of the chassis which is normally stationary during the casting operation are preferably provided by an electromechanical jack imparting a displacement to said trough-bearing cart at a speed of advance higher than the speed of the casting line.

4. The system of claim 1 wherein position control of the metal molten transfer troughs is provided perpendicularly to the displacement direction of the mobile cart by an intermediate cart displaceable upon a rollway and angularly in a horizontal plane about a pivot carried by the intermediate cart.

5. Supply system according to claim 1 wherein the means for controlling the quantity of metal delivered by the closing rods from the heated ladle comprise an infrared detector positioned near a vent of the molds carried by the continuous casting line, the detector emitting an electrical signal supplied to the arrangement controlling the re-descent and closure of the closing rods when the filling level of the molds is reached.

6. Supply system according to claim 1 wherein the means for control of the quantity of metal delivered comprise a mechanical balance with deflection detector, the balance being provided with a ladle capable of occupying at least two positions, one of filling and weighing, the other of pouring into a pouring trough, the balance emitting, after having reached a weight reference threshold, an electric signal supplied to the arrangement which controls the re-descent and closure of the closing rods prior to the said emptying.

7. The system of claim 1 wherein the means for controlling the quantity of metal delivered by the closing rods comprises a timing arrangement emitting an electric signal supplied to the arrangement which controls the re-descent and closure of the closing rods when the end of the opening period of the closing rods is reached.

8. The system of claim 1 wherein the indexing means adapted to control the displacements of the main trough-bearing cart comprises reference marks carried by the molds or boxless molding devices of the casting line or constituted by the spaces between molds, sensors adapted to emit signals supplied to the displacing means for the trough-bearing cart to bring said troughs into alignment with the casting orifices of the molds or boxless molding devices, signals applied to the opening control arrangements for the closing rods when alignment between the reference marks and sensors is achieved.

9. The supply system of claim 1 wherein the molten metal reserve ladle is heated by induction.

10. Supply system according to claim 1 wherein the molten metal reserve ladle is heated by flame burner.

* * * * *